United States Patent [19]

Killian, Jr.

[11] Patent Number: 4,787,858

[45] Date of Patent: Nov. 29, 1988

[54] LATCHING SYSTEM FOR COMPUTER PLUG

[75] Inventor: John C. Killian, Jr., Sudbury, Mass.

[73] Assignee: Digital Equipment Corporation, Maynard, Mass.

[21] Appl. No.: 29,333

[22] Filed: Mar. 23, 1987

[51] Int. Cl.[4] ..... H01R 13/639

[52] U.S. Cl. ..... 439/350; 439/372

[58] Field of Search ..... 439/310, 345, 350–354, 439/372

[56] References Cited

U.S. PATENT DOCUMENTS

| | | | |
|---|---|---|---|
| 2,542,404 | 2/1951 | Ensign | 439/372 |
| 4,435,033 | 3/1984 | Gansert et al. | 439/358 |
| 4,534,608 | 8/1985 | Scott et al. | 439/345 |
| 4,556,270 | 12/1985 | Schutzle et al. | 439/372 |
| 4,586,766 | 5/1986 | Hofmeister | 439/350 |

*Primary Examiner*—J. Patrick McQuade

*Attorney, Agent, or Firm*—Hayes, Soloway, Hennessey & Hage

[57] ABSTRACT

In a plug and socket as for a computer wherein the plug has tabular projections on opposed ends and the socket has wire latches pivotally mounted between raised members into bores therethrough for releasably engaging slots in the projections to hold the plug in the socket, a replacement latch for replacing one or both of the wire latches. A pivot rod is disposed through and between the bores in the raised members. A body portion is disposed between the bores in the raised member and pivotally mounted on the pivot rod with an engaging lip extending inward to snap over the projection, when the plug is seated in the socket, in a first locking position to hold the plug in the socket. The body portion is pivotable from the first position to a second retracted position wherein the engaging lip is removed from engagement with the projection so that the plug can be removed. An optional operating arm is carried by the body portion. An auxiliary member of spring metal is disposed under the body portion and includes a bias leaf spring operably connected to the body portion for urging the body portion towards the first position and a detent member operably connected to the body portion for releasably holding the body portion in a rotationally more distant third position against the bias force of the bias spring.

20 Claims, 4 Drawing Sheets

LATCHING SYSTEM FOR COMPUTER PLUG

BACKGROUND OF THE INVENTION

The present invention relates to electrical plugs and sockets such as those used for releasably attaching computer cables and, more particularly, in a plug and socket wherein the plug has tabular projections on opposed ends and the socket has wire latches asasociated therewith pivotally mounted between raised members into bores therein for releasably engaging slots in the projections to hold the plug in the socket, to the latch for replacing one or both of the wire latches and in one embodiment releasable from the opposite end and comprising—a pivot rod disposed through and between the bores in the raised members; a body portion disposed between the bores in the raised members and including a bore therethrough by means of which the body portion is pivotally mounted on the pivot rod, the body portion having an engaging lip extending inward therefrom towards the projection when the plug is seated in the socket and disposed to snap over the projection in a first locking position to hold the plug in the socket, the engaging lip forming a horizontal stop surface over the projection and the pivot point formed by the bore in the body portion and the pivot rod therein, the body portion being pivotable to a second retracted position wherein the engaging lip is removed from engagement with the projection so that the plug can be removed; and, an operating arm carried by the body portion whereby the body portion can be moved between the first and second positions by the operating arm.

Computers and similar electronic devices typically employ multi-conductor plugs such as that indicated as 10 in FIG. 1 to attach peripheral devices and interconnect various components and subsystems. The plug 10 is inserted into its matching socket 12 and releasably held in place by a pair of wire latch assemblies 14. The plug 10 has outward-facing tabular projections 16 on the ends thereof. Each projection 16 has a "keyhole" slot 18 therein as best seen in the bottom view of FIG. 3. Adjacent each slot 18 as part of the socket 12 are a pair of raised members 20 each having a bore 22 therethrough. A wire latch 24, as best seen with reference to FIG. 2, has its ends inserted into each of the bores 22 so as to be pivotal between the raised or locked position shown in solid in FIG. 1 and the lowered or unlocked position shown ghosted in FIG. 1. As the latch 24 is raised into its locked position, the sides of the latch 24 move together, as indicated by the arrows 26 in FIG. 2, so as to snap into the slot 16 and remain there. This latching action normally requires a firm push against the latch 24.

Where there is direct and easy access to both ends of the plug 10, locking and unlocking of the above-described prior art wire latch assemblies 14 is fairly simple and straightforward. Many larger computer installations, however, employ such plugs and sockets internally for interconnection cables, and the like, in the manner depicted in FIG. 1; that is, one end and its associated latch assembly 14 is facing to the front with easy access while the other end and the latch assembly 14 associated therewith faces to the back so as to be virtually inaccessible for locking and unlocking the latch assembly 14. Moreover, the latching of the latch assembly 14 is something that can be easily overlooked or ignored by persons not realizing the importance of the plug being securely held in place.

Wherefore, it is the object of the present invention to provide a latch which can be substituted for the back wire latch 24 and be operated from the front in a front-to-back plug orientation such as depicted in FIG. 1 wherein the prior art wire latch is inoperable because of a lack of space for hand access for the required manipulation thereof.

It is a further object of the present invention to provide a latch which can be substituted for one or both of the wire latchs 24 which will automatically lock the plug in place as it is inserted and not require a separate locking movement on the part of the human making the insertion.

SUMMARY

The foregoing object has been achieved in a computer cable plug and socket wherein the plug has tabular projections on opposed ends and the socket has wire latches associated therewith which are pivotally mounted between raised members into bores therein for releasably engaging slots in the projections to hold the plug in the socket by the latch of the present invention which, in one embodiment, is releasable from the opposite end, which directly replaces one of the wire latches, and which comprises, a pivot rod disposed through and between the bores in the raised members; a body portion disposed between the bores in the raised members and including a bore therethrough by means of which the body portion is pivotally mounted on the pivot rod, the body portion having an engaging lip extending inward therefrom towards the projection when the plug is seated in the socket and disposed to snap over the projection in a first locking position to hold the plug in the socket, the engaging lip forming a horizontal stop surface over the projection and the pivot point formed by the bore in the body portion and the pivot rod therein, the body portion being pivotable to a second retracted position wherein the engaging lip is removed from engagement with the projection so that the plug can be removed; and, an operating arm carried by the body portion whereby the body portion can be moved between the first and second positions.

In the preferred embodiment as intended for use at the back, inaccessible end of a plug, the operating arm is shaped to extend from the body portion alongside the plug to the opposite end of the plug when the plug is in the socket whereby the body portion can be moved between the first and second positions by the operating arm from the opposite end of the plug from the body portion.

Also in the preferred embodiment, the surface of the body portion above the engaging lip is angled into a camming surface so that the body portion is urged from the first position to just short of the second position by the projection riding along the camming surface as the plug is inserted into the socket.

Additionally in the preferred embodiment, there is an auxiliary member of spring metal disposed under the body portion which includes bias means operably connected to the body portion for urging the body portion towards the first position, detent means operably connected to the body portion for releasably holding the body portion in a third position against the bias force of the bias means, release means operably connected to the detent means for contacting the projection as the plug is inserted into the socket and for releasing the detent means to allow the body portion to move to the second position and thence to the first position as a plug is inserted into the socket, and stop means for contacting the operating arm to prevent movement thereof past the first position in an amount which would bend and damage the projection. Optionally, the auxiliary member may include the raised members if not otherwise available.

DESCRIPTION OF THE DRAWINGS

FIG. 8 is a perspective view of the components of the present invention in its preferred embodiment as intended for replacement of one of the prior art wire latches by mounting to the same raised members as the wire latch was mounted to.

DESCRIPTION OF THE PREFERRED EMBODIMENT

While the latch described hereinafter was primarily designed as a retrofit or modification to an existing latch for a computer plug, those skilled in the art will recognize that the same benefits could be obtained by incorporating the latch of the present invention into a plug and socket arrangement secially designed for the purpose. Therefore, it is applicant's intent that the scope and spirit accorded the description and appended claims that follow hereinafter cover both approaches to the present invention.

Figure 4:
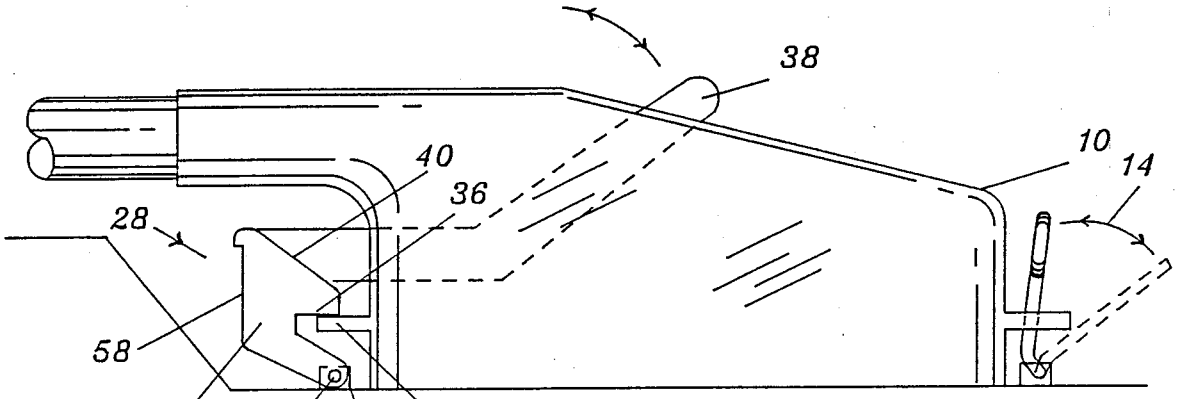
FIG. 4 is a side view of the computer plug and socket of FIG. 1 with the latch of the present invention substituted for one of the wire latches thereof.
Figure 6:
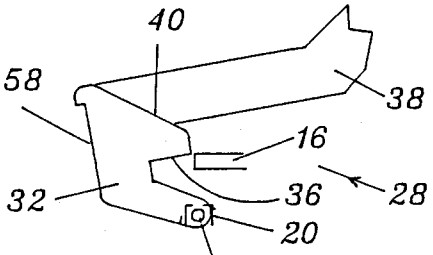
FIG. 6 is a simplified side view of the present invention in its second or unlocked position.
Figure 5:
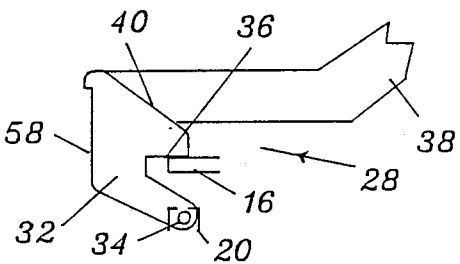
FIG. 5 is a simplified side view of the present invention in its first or locked position.

The present invention is shown in FIGS. 4–11. In its simplest form it comprises a unitary latch generally indicated as 28 in the figures. Latch 28 can be formed of metal or plastic and comprises a body portion 32 sized to fit between the raised members 20 of the prior art latch assembly 14 after the wire latch 24 has been removed therefrom or in other similar raised members provided for the purose. A bore 30 is provided transversely through the bottom front edge of the body portion 32 in alignment with the bores 22 in the raised members 20. A pivot rod 34 in the form of a roll pin, or the like, is disposed through the bores 22, 30 so that the body portion 32 can pivot thereon. The body portion 32 has an engaging lip 36 facing the projection 16 on the adjacent end of the plug 10. The body portion 32 is pivotable between a first position as shown in FIGS. 4 and 5 where the engaging lip 36 is over the projection 16 thus holding the plug 10 in place against removal and a second position as shown in FIG. 6 where the engaging lip 36 is removed from interacting with the tabular projection 16 so that the plug 10 can be removed. When the body portion is in the first position of FIGS. 4 and 5, as can be seen therein, the engaging lip 36 forms a horizontal stop surface over the projection 16 and the pivot point formed by the bore 30 and pivot rod 32 therein. As will be appreciated by those skilled in the art, the stop surface formed by the engaging lip 34 should have such a relationship to the projection 16 and bore 30 and pivot rod 32 so as to prevent withdrawal of the plug 10. Other arrangements may permit the projection 16 to merely exert a pivoting force on the engaging lip 34 such as to merely pivot the body portion 32 back to the second position of FIG. 6, allowing the plug 10 to be withdrawn.

In this embodiment, which is intended for use with plugs having an inaccessible rear latch, an operating arm 38 extends from the body portion 32 and is shaped to extend from the body portion 32 alongside the plug 10 to the opposite end of the plug when the plug is in the socket 12. Thus, the body portion 32 can be moved between the first and second (i.e. locked and unlocked) positions by using the operating arm 38 from the opposite end of the plug 10 from the body portion 32. As will be appreciated, while a unitary construction of the latch 28 is preferred, the operating arm 38 could be a separate item to be attached to the body portion 32 such as with screws, or the like.

Figures 1, 2, 3:
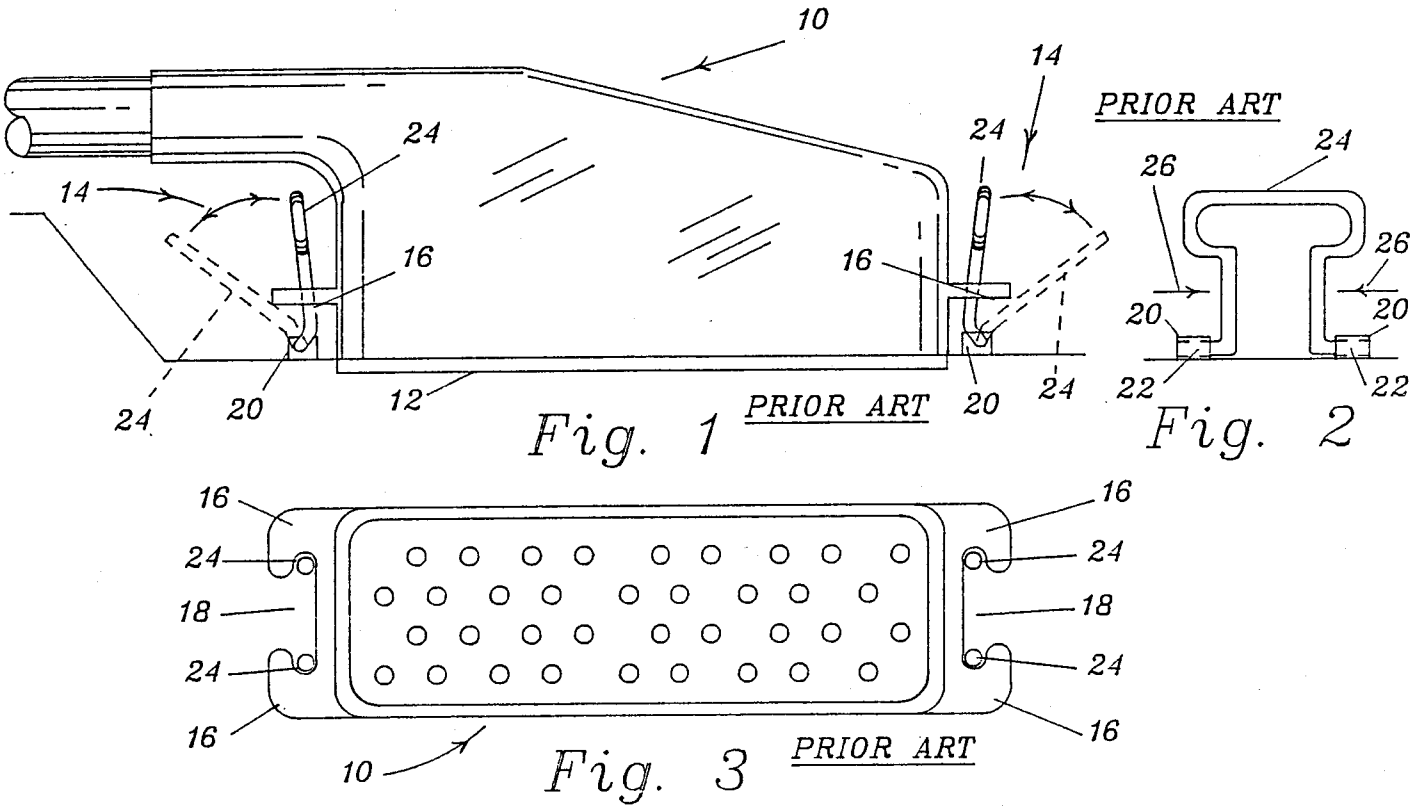
Fig. 1 PRIOR ART
Fig. 3 PRIOR ART
FIG. 1 is a side view of a computer plug and socket employing prior art wire latches.
FIG. 2 is an end view with respect to the plug of FIG. 1 showing the shape of the wire latches employed therein.
FIG. 3 is a bottom view of the plug of FIG. 1 showing how the wire latches engage the slots in the projections thereof to affect locking of the plug into the socket.

While the latch 28 as thus described offers an order of magnitude improvement in the ability to lock and unlock a plug and socket disposed in the manner of FIG. 1, certain additional features which will now be described make the latch of the present invention even more useful.

First, the surface 40 above the engaging lip 36 is angled at about 45° from the lip 36 up and back so as to form a camming surface. With the plug 10 removed from the socket 12, the latch 28 will most likely assume the first position of FIG. 5 due to the weight of the operating arm 38 extending forward over the pivot rod 34 (or an optional bias spring to be described shortly). Without the camming surface 40, the operating arm 38 would have to be physically raised to place the latch 28 in the second position of FIG. 6 before the plug 10 could be inserted into the socket 12 since the projection 16 would otherwise strike the top of the engaging lip 36 and prevent insertion. With the camming surface 40, however, the projection 16, upon insertion of the plug 10, contacts and rides along the camming surface 40 thus urging the latch 28 towards the second position. It should also be noted and appreciated that in many instances (depending on the shape and positioning of the associated components) once the projection 16 has passed the engaging lip 36, the operating arm 38 may be able to be moved downward to cause the engaging lip 36 to press against the projection 16 and aid in fully inserting the plug 10 into the socket 12. This can be particularly beneficial where access to the rear of the plug 10 is a real problem.

Figure 7:
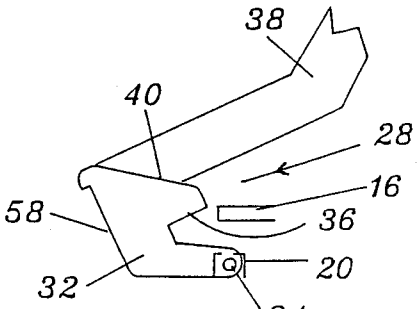
FIG. 7 is a simplified side view of the present invention in its third or detented position.
Figure 8:
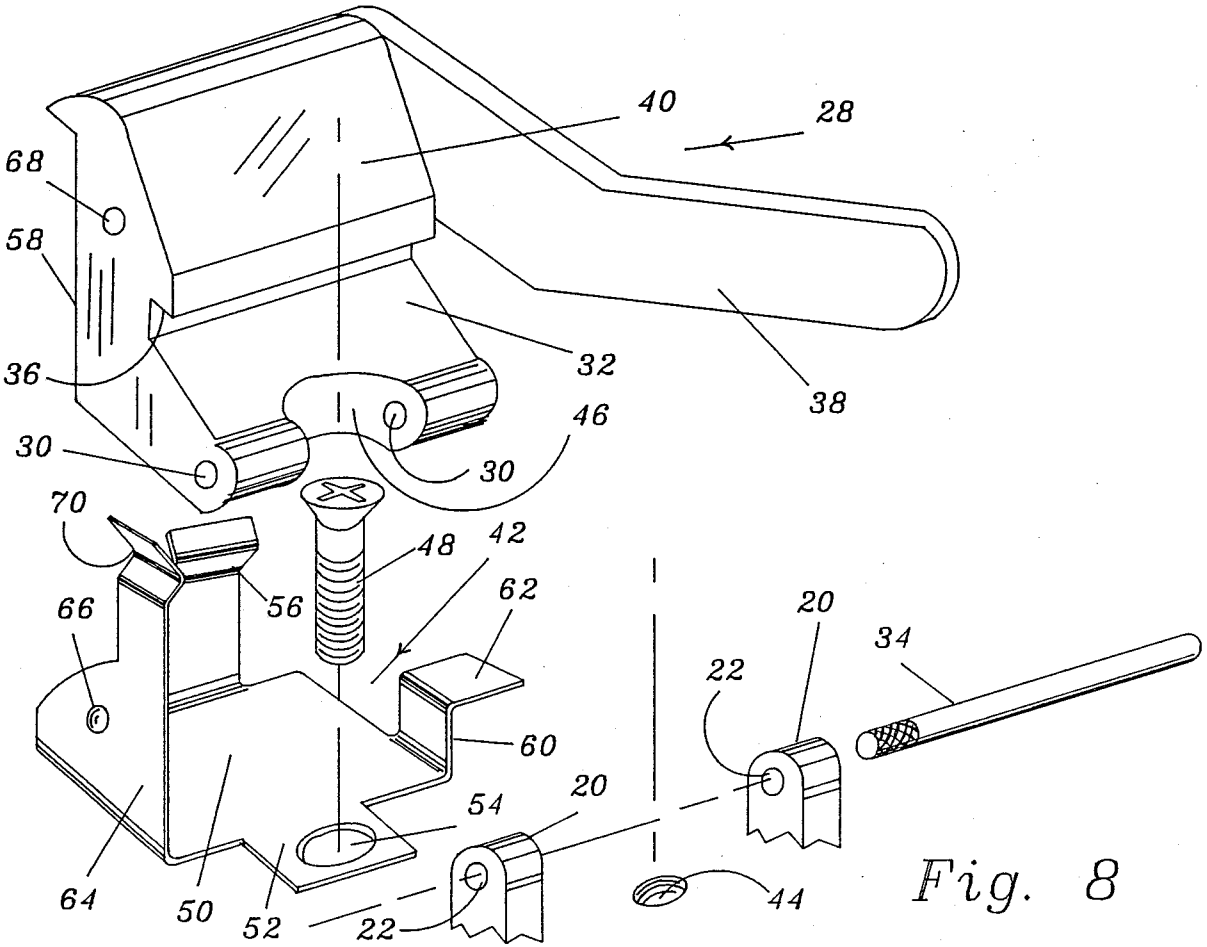
Figure 10:
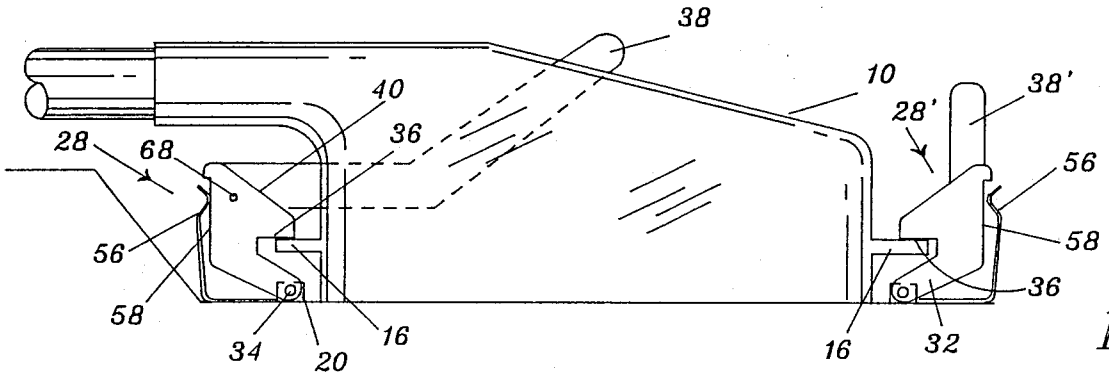
FIG. 10 is a side view of a plug incorporating the present invention therewith showing the rear latch with the bias spring acting thereon as well as a second embodiment of the latch of the present invention to replace the front latch.

Additional benefits are obtained by the addition of the auxiliary member 42 of spring metal shown in FIG. 8, which is disposed under the body portion 32. Most prior art sockets have a threaded bore 44 between the raised members 20 by means of which the socket 12 is attached to the surrounding surface. The body portion 32 has a clearance opening 46 through the lower front edge (i.e. the pivoting edge) to allow a screw 48 to pass therethrough and to allow the body portion 32 to pivot without interference by the screw 48. The auxiliary member 42 has a flat base 50 with a projecting front portion 52 adapted to fit between the raised members 20 and over the threaded bore 44. The front portion 52 has a bore 54 therethrough aligned with the treaded bore 44 so that the auxiliary member 42 can be held in place beneath the body portion 32 by screw 48 being threaded through the bore 54 and into the threaded bore 44. Other methods of affixing the auxiliary member 42 could, of course, be employed. The auxiliary member 42 has three vertical members extending upwards from the base 50 at right angles thereto and adapted to perform various functions. At the rear is a bias leaf spring member 56 positioned to contact the rear surface 58 of the body portion 32 and actively urge it towards the first or locked position as best seen in FIG. 10. At one side and under the path of the operating arm 38 is a stop member 60 having a horizontal top 62 which prevents the operating arm 38 from being moved beyond a point where further movement would bend and damage the projection. Finally, on the side opposite the stop member 60 is an automatically releasable detent member 64. The detent member 64 has an inward-facing dimple 66 formed therein which is positioned to engage a matching bore 68 (or dimple) in the side of the body portion 32 when the body portion 32 is in a third, i.e. detented, position as shown in FIG. 7. As can be seen and appriciated from the drawings, the third position is rotationally more distant from the first position than the second position. The dimple 66 is sized with relationship to the bore 68 so as to be able to hold the body portion 32 in the third position against the bias force of the spring member 56. At the top of the detent member 64 is an inward-facing release camming surface 70 which is positioned to be contacted by the side of the projection 16 as the plug 10 is inserted into the socket 12. As the plug 10 is inserted, the projection 16 moves along the camming surface 70 thus urging the detent member 64 outward until the dimple 66 moves out of the bore 68 sufficiently for the bias spring member 56 to move the body portion 32 towards the second and first positions. Thereafter, insertion of the plug 10 and subsequent locking by the latch 28 is as hereinbefore described. For optimum operation, the camming surface 70 is positioned to release the body portion 32 just as the projection 16 is under the engaging lip 36 causing the body portion to snap forward and lock the plug in place. It should be noted that with the latch of the present invention, either with or without the detent action as described above, as the latch 28 moves to the first or locked position over the projection 16 there is an audible "snap" which verifies to the person making the insertion that it has been successfully accomplished even where visual confirmation cannot be made.

Figure 11:
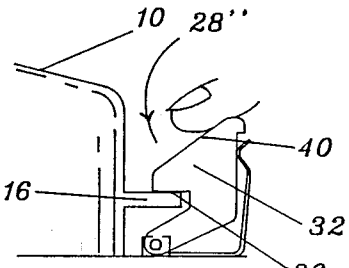
FIG. 11 is a side view of a portion of a plug incorporating the latch of the present invention in a third embodiment having no operating arm to replace the front latch.
Figure 9:
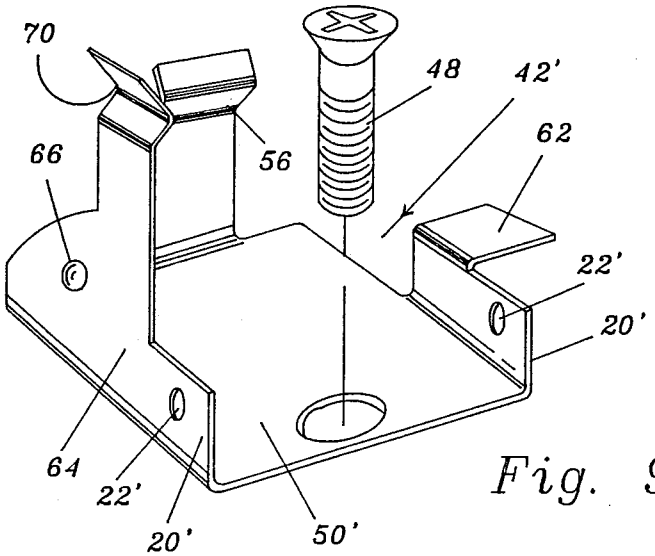
FIG. 9 is a perspective view of the auxiliary member of the present invention in an alternate embodiment providing the raised members and pivot bores therein.

Several other variations possible with the present invention can be seen with reference to FIGS. 9–11. In FIG. 9 there is an alternate embodiment of the auxiliary member, labelled as 42', which incorporates the raised members 22' having the pivot bores 20' therein extending upward from the base 52'. This arrangement can be used where there are no existing raised members 22 or, for example, where one of the original raised members 22 has been damaged.

On the right hand side of FIG. 10 as it is viewed (i.e. at the front of the plug 10) a second embodiment of the present invention, labelled as 28', is shown replacing the front wire latch 14. Latch 28' is substantially as previously described except that the originally described operating arm 38 (which was configured to extend along the length of the plug 10 to permit operation from the opposite end) has been replaced with a shorter operating arm 38'. Taking this one step further, in FIG. 11 there is another embodiment of the latch of the present invention labelled as 28'' and intended for use where there is good physical access wherein the operating arm 38 has been removed altogether. In this embodiment, the latch 28'' is operated by finger pressure against the camming surface 40 of the body member 32 as shown.

Thus it can be seen from the foregoing description that the present invention has truly met its objectives by providing a replacement latch which operates easily and efficiently from the opposite end of the plug in instances where direct access to the latch area is difficult or impossible. Moreover, as has been described, the latch can be used in alternate embodiments to replace one or both wire latches normally used with computer plugs to provide automated latching wherein the latch need only be manually disengaged to affect removal of the plug.

Wherefore, having thus described my invention, I claim:

1. In an assembly including a plug and socket wherein the plug has a tabular projection on each of opposed ends and the socket has raised members having bores therein for pivotally mounting a latch for releasably engaging a said projection to hold the plug in the socket, a latch comprising:

(a) a pivot rod disposed in and between the bores in the raised members;

(b) a body portion disposed between the bores in the raised members and including a bore therethrough adjacent a front edge by means of which said body portion is pivotally mounted on said pivot rod, said body portion having an engaging lip extending towards the said projection when the plug is seated in the socket and disposed to snap over the said projection in a first locking position to hold the plug in the socket, said engaging lip forming a horizontal stop surface over the said projection and the pivot point formed by said bore in said body portion and said pivot rod therein, said body portion being pivotable to a second retracted position wherein said engaging lip is removed from engagement with the projection so that the plug can be removed; and (c) an operating arm carried by said body portion whereby said body portion can be moved between said first and second positions by said operating arm; wherein said operating arm is shaped to extend from said body portion alongside the plug to the opposite end of the plug when the plug is in the socket whereby said body portion can be moved between said first and second positions by said operating arm from the opposite end of the plug from said body portion.

2. In an assembly of claim 1 wherein:

the surface of said body portion above said engaging lip is angled to form a camming surface so that said body portion is urged from said first position to said second position by the said projection riding along said camming surface as the plug is inserted into the socket.

3. In an assembly of claim 1 and additionally comprising:

bias means operably connected to said body portion for urging said body portion towards said first position.

4. In an assembly of claim 3 and additionally comprising:

detent means operably connected to said body portion for releasably holding said body portion in a third position rotationally more distant from said first position than said second position against the bias force of said bias means.

5. In an assembly of claim 4 and additionally comprising:

release means operably connected to said detent means for contacting the said projection as the plug is inserted into the socket and for releasing said detent means to allow said body portionto move from said third position to said second and first positions as a plug is inserted into the socket.

6. In an assembly of claim 1 and additionally comprising:

stop means for contacting said operating arm to prevent movement thereof past said first position in an amount which would bend the said projection.

7. In an assembly of claim 1 and additionally comprising:

an auxiliary member of spring metal disposed under said body portion and including bias means operably connected to said body portion for urging said body portion towards said first position, detent means operably connected to said body portion for releasably holding said body portion in a third position rotationally more distant from said first position than said second position against the bias force of said bias means, release means operably connected to said detent means for contacting the said projection as the plug is inserted into the socket and for releasing said detent means to allow said body portion to move from said third position to said second and first positions as a plug is inserted into the socket and stop means for contacting said operating arm to prevent movement thereof past said first position in an amount which would bend the projection.

8. In an assembly of claim 1 and additionally comprising:

an auxiliary member of spring metal disposed under said body portion and including bias means operably connected to said body portion for urging said body portion towards said first position, detent means operably connected to said body portion for releasably holding said body portion in a third position rotationally more distant from said first position than said second position against the bias force of said bias means, and release means operably connected to said detent means for contacting the said projection as the plug is inserted into the socket and for releasing said detent means to allow said body portion to move from said third position to said second and first positions as a plug is inserted into the socket.

9. In an assembly of claim 1 and additionally comprising:

an auxiliary member disposed under said body portion and including a pair of raised members having pivot bores therethrough.

10. In an assembly of claim 9 wherein said auxiliary member is of spring metal and additionally includes:

(a) bias means operably connected to said body portion for urging said body portion towards said first position;

(b) detent means operably connected to said body portion for releasably holding said body portion in a third position rotationally more distant from said first position than said second position against the bias force of said bias means; and, (c) release means operably connected to said detent means for contacting the said projection as the plug is inserted into the socket and for releasing said detent means to allow said body portion to move from said third position to said second and first positions as a plug is inserted into the socket.

11. A latch for releasably locking a plug having a tabular projection on each of opposed ends into a mating socket wherein the latch comprises:

(a) a pivot rod mounted adjacent and parallel to one end of the socket;

(b) a body portion having a bore therethrough adjacent a lower front edge by means of which said body portion is pivotally mounted on said pivot rod, said body portion having an engaging lip extending towards a said projection when the plug is seated in the socket and disposed to snap over the said projection in a first locking position to hold the plug in the socket, said engaging lip forming a horizontal stop surface over the said projection and the pivot point formed by said bore in said body portion and said pivot rod therein, said body portion being pivotable to a second retracted position wherein said engaging lip is removed from engagement with the said projection so that the plug can be removed, and an operating arm carried by said body portion whereby said body portion can be moved between said first and second positions by said operating arm; wherein;

said operating arm is shaped to extend from said body portion alongside the plug to the opposite end of the plug when the plug is in the socket whereby the latch can be operated from the opposite end of the plug from said body portion.

12. The latch of claim 11 wherein:

the surface of said body portion above said engaging lip is angled to form a camming surface so that said body portion is urged from said first position to said second position by the said projection riding along said camming surface as the plug is inserted into the socket.

13. The latch of claim 11 and additionally comprising;

bias means operably connected to said body portion for urging said body portion towards said first position.

14. The latch of claim 13 and additionally comprising:

detent means operably connected to said body portion for releasably holding said body portion in a third position rotationally more distant from said first position than said second position against the bias force of said bias means.

15. The latch of claim 14 and additionally comprising:

release means operably connected to said detent means for contacting the said projection as the plug is inserted into the socket and for releasing said detent means to allow said body portion to move from said third position to said second and first positions as a plug is inserted into the socket.

16. The latch of claim 11 and additionally comprising: stop means for contacting said operating arm to prevent movement thereof past said first position in an amount which would bend the said projection.

17. The latch of claim 11 and additionally comprising: an auxiliary member of spring metal disposed under said body portion and including bias means operably connected to said body portion for urging said body portion towards said first position, detent means operably connected to said body portion for releasably holding said body portion in a third position rotationally more distant from said first position than said second position against the bias force of said bias means, release means operably connected to said detent means for contacting the said projection as the plug is inserted into the socket and for releasing said detent means to allow said body portion to move from said third position to said second and first positions as a plug is inserted into the socket, and stop means for contacting said operating arm to prevent movement thereof past said first position in an amount which would bend the said projection.

18. The latch of claim 11 and additionally comprising: an auxiliary member of spring metal disposed under said body portion and including bias means operably connected to said body portion for urging said body portion towards said first position, detent means operably connected to said body portion for releasably holding said body portion to a third position rotationally more distant from said first position than said second position against the bias force of said bias means, and release means operably connected to said detent means for contacting the said projections as the plug is inserted into the socket and for releasing said detent means to allow said body portion to move from said third position to said second and first positions as a plug is inserted into the socket.

19. The latch of claim 11 and additionally comprising: an auxiliary member disposed under said body portion and including a pair of raised members having pivot bores therethrough.

20. The latch of claim 19 wherein said auxiliary member is of spring metal and additionally includes:

(a) bias means operably connected to said body portion for urging said body portion towards said first position;

(b) detent means operably connected to said body portion for releasably holding said body portion in a third position rotationally more distant from said first position than said second position against the bias force of said bias means; and, (c) release means operably connected to said detent means for contacting the said projection as the plug is inserted into the socket and for releasing said detent means to allow said body portion to move from said third position to said second and first positions as a plug is inserted into the socket.

* * * * *